US010371344B2

(12) United States Patent
Rossi

(10) Patent No.: US 10,371,344 B2
(45) Date of Patent: Aug. 6, 2019

(54) CEILING FAN LAMPSHADE MOUNTING ASSEMBLY

(71) Applicant: Maura Rossi, Ft. Lauderdale, FL (US)

(72) Inventor: Maura Rossi, Ft. Lauderdale, FL (US)

( * ) Notice: Subject to any disclaimer, the term of this patent is extended or adjusted under 35 U.S.C. 154(b) by 0 days.

(21) Appl. No.: 15/229,941

(22) Filed: Aug. 5, 2016

(65) Prior Publication Data

US 2017/0045197 A1 Feb. 16, 2017

Related U.S. Application Data

(60) Provisional application No. 62/204,792, filed on Aug. 13, 2015.

(51) Int. Cl.

| | |
|---|---|
| ***F21V 1/08*** | (2006.01) |
| ***F21V 33/00*** | (2006.01) |
| ***F04D 25/08*** | (2006.01) |
| ***F04D 29/00*** | (2006.01) |
| ***F21V 17/00*** | (2006.01) |

(52) U.S. Cl.

CPC ..... *F21V 1/08* (2013.01); *F04D 25/088* (2013.01); *F04D 29/005* (2013.01); *F21V 17/002* (2013.01); *F21V 33/0096* (2013.01)

(58) Field of Classification Search

CPC ..... B62D 35/005; B62D 35/02

See application file for complete search history.

(56) References Cited

U.S. PATENT DOCUMENTS

| | | | | |
|---|---|---|---|---|
| 483,615 | A * | 10/1892 | Johnson | F21V 1/08 362/417 |
| 2,119,398 | A | 5/1938 | Morse | |
| 2,230,186 | A | 1/1941 | Johns | |
| 4,685,038 | A * | 8/1987 | Huang | F21V 1/06 362/147 |
| 4,750,863 | A | 6/1988 | Scoggins | |
| 5,440,459 | A | 8/1995 | Chan | |
| 5,528,469 | A | 6/1996 | Todd, Jr. | |
| 6,350,045 | B1 | 2/2002 | Pearce | |
| 6,655,821 | B1 | 12/2003 | Tai | |
| 6,979,108 | B1 | 12/2005 | Berge | |
| 8,430,541 | B2 | 4/2013 | Ko | |
| 8,721,107 | B2 | 5/2014 | Cotzias | |
| 8,794,784 | B1 | 8/2014 | Maloney | |
| 2003/0210982 | A1 | 11/2003 | Chen | |
| 2007/0247854 | A1 | 10/2007 | Lin | |
| 2013/0201695 | A1 * | 8/2013 | Lewis | F21V 1/02 362/353 |

* cited by examiner

*Primary Examiner* — Joseph L Williams
*Assistant Examiner* — Jacob R Stern
(74) *Attorney, Agent, or Firm* — H. John Rizvi; The Patent Professor

(57) ABSTRACT

A ceiling fan lampshade mounting assembly for mounting a lampshade on a ceiling fan includes an adjustable support configured for attachment to the ceiling fan and a plurality of lampshade support members carried by the adjustable support, each of the plurality of lampshade support members configured to engage and support the lampshade. The ceiling fan lampshade mounting assembly mounts a lampshade having a selected appearance over one or more lights on the ceiling fan.

17 Claims, 16 Drawing Sheets

CEILING FAN LAMPSHADE MOUNTING ASSEMBLY

CROSS-REFERENCE TO RELATED APPLICATIONS

This application claims the benefit of U.S. Provisional Patent Application Ser. No. 62/204,792, filed Aug. 13, 2016, which is incorporated herein in its entirety.

FIELD OF THE INVENTION

The present invention relates generally to ceiling fans, and more particularly, to a ceiling fan lampshade mounting assembly which mounts a lampshade having a selected appearance over one or more lights on a ceiling fan.

BACKGROUND OF THE INVENTION

Various home furnishings are used to decorate the interiors of homes and businesses. For example, floor lamps and table lamps may be used by homemakers and interior decorators to enhance the interior aesthetics of a home or business as well as to provide increased interior lighting. Floor lamps and table lamps typically include a base, a light fixture which extends from the base and a lampshade supported over the light fixture. The lampshade softens the light emitted by the light fixture and may have any of a variety of designs which accord with the aesthetic tastes of the user.

Ceiling fans frequently include one or more lights for illuminating a room in which the ceiling fan is mounted. The lights may be provided on the ceiling fan in the form of a single light bulb or multiple light bulb or lamps which interface with sockets in the ceiling fan motor housing of the ceiling fan. Some ceiling fans may include a spherical glass globe which encloses one or more light bulbs and attaches the ceiling fan motor housing.

A variety of ceiling fan lights is available to end users. However, ceiling fan lighting designs which accord with a variety of aesthetic tastes are limited. Therefore, end users may encounter difficulty in finding a ceiling fan lighting design which matches a ceiling fan having a particular appearance.

Accordingly, there is an established need for ceiling fan lampshade mounting assemblies which mount a lampshade having a selected appearance over one or more lights on a ceiling fan.

SUMMARY OF THE INVENTION

The present invention is directed to a ceiling fan lampshade mounting assembly which allows mounting a lampshade having a selected appearance over one or more lights on a ceiling fan. The ceiling fan lampshade mounting assembly includes an adjustable support which attaches to the ceiling fan. Multiple lampshade support members extend from the adjustable support. A lampshade is supported by the lampshade support members.

In a first implementation of the invention, a ceiling fan lampshade mounting assembly comprises an adjustable support configured for adjustable attachment to the ceiling fan, and a plurality of lampshade support members carried by the adjustable support, each of the lampshade support members configured to engage and support the lampshade.

In a second aspect, at least one of the lampshade support members can be removably carried by the adjustable support. For instance, the at least one of the lampshade support members can be removably hooked onto the adjustable support. In other embodiments, the at least one of the lampshade support members can slidably couple into a respective at least one mount slot provided on the adjustable support.

In another aspect, at least one of the lampshade support members can be slidably carried by the adjustable support.

In another aspect, at least one of the lampshade support members can be length adjustable to vary a length in which the at least one of the lampshade support members protrudes outwardly from the adjustable support.

In another aspect, the ceiling fan lampshade mounting assembly can be configured to adopt a working position in which the adjustable support forms a loop arranged around and adjusted onto a perimeter of the ceiling fan, said loop being size-adjustable. The adjustable support can include at least one fastener to retain the adjustable support onto the perimeter of the ceiling fan in the working position. The lampshade support members can extend radially outward from the adjustable support when the ceiling fan lampshade mounting assembly is in the working position. In some embodiments, the lampshade support members can include a respective body having a floor and side walls delimiting a cavity, the cavity oriented radially outward when the ceiling fan lampshade mounting assembly is arranged in the working position. The lampshade support members can also include a respective rear hook arranged radially inward of the cavity when the ceiling fan lampshade mounting assembly is arranged in the working position. In other embodiments, at least one of the lampshade support members can include a support arm attached to the adjustable support, and an arm extension extending from the support arm, wherein a distal end of the arm extension is optionally curved.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration," Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a ceiling fan lampshade mounting assemblies which mount a lampshade having a selected appearance over one or more lights on a ceiling fan. The ceiling fan lampshade mounting assemblies enable a user to select any of a variety of lampshades which accord with the aesthetic tastes of the user for attachment to the ceiling fan.

Figure 6:
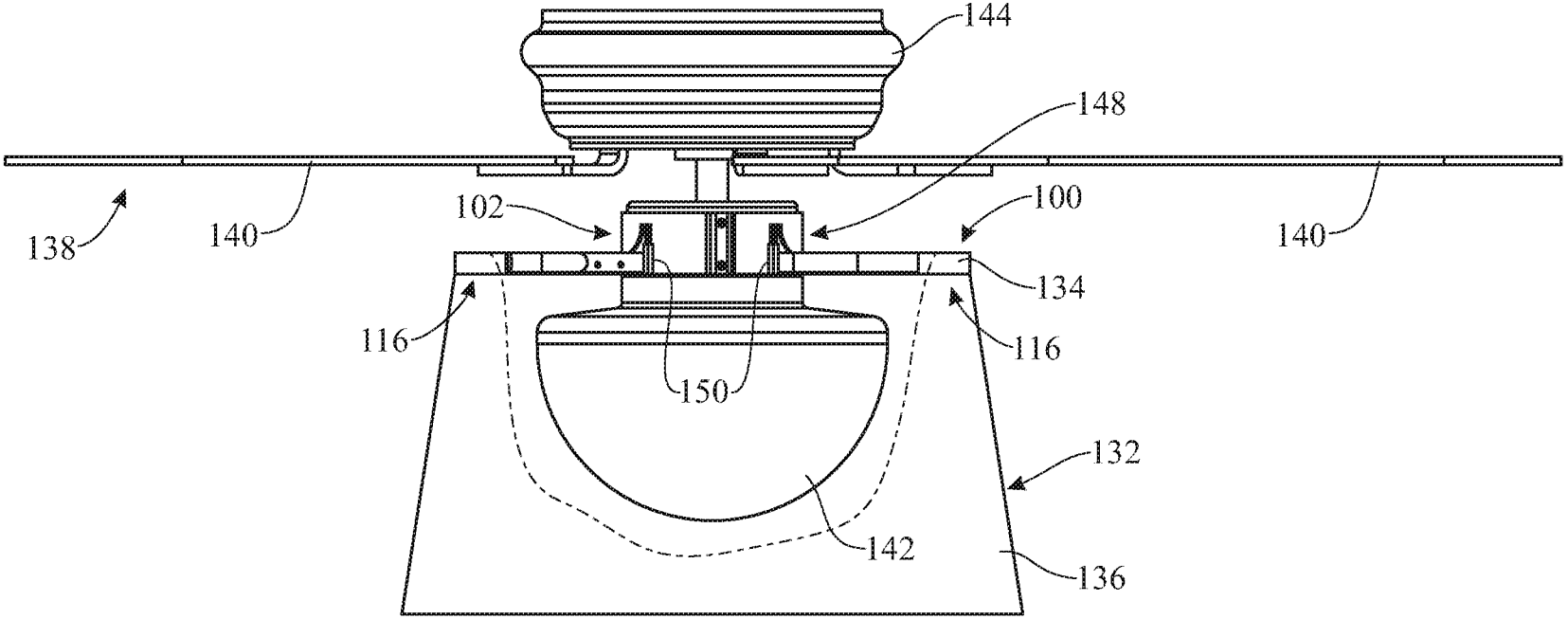
FIG. 6 presents a side view of a ceiling fan with the ceiling fan lampshade mounting assembly mounted on the light fixture on the ceiling fan and the lampshade deployed in place on the ceiling fan lampshade mounting assembly in typical application of the assembly.
Figure 7:
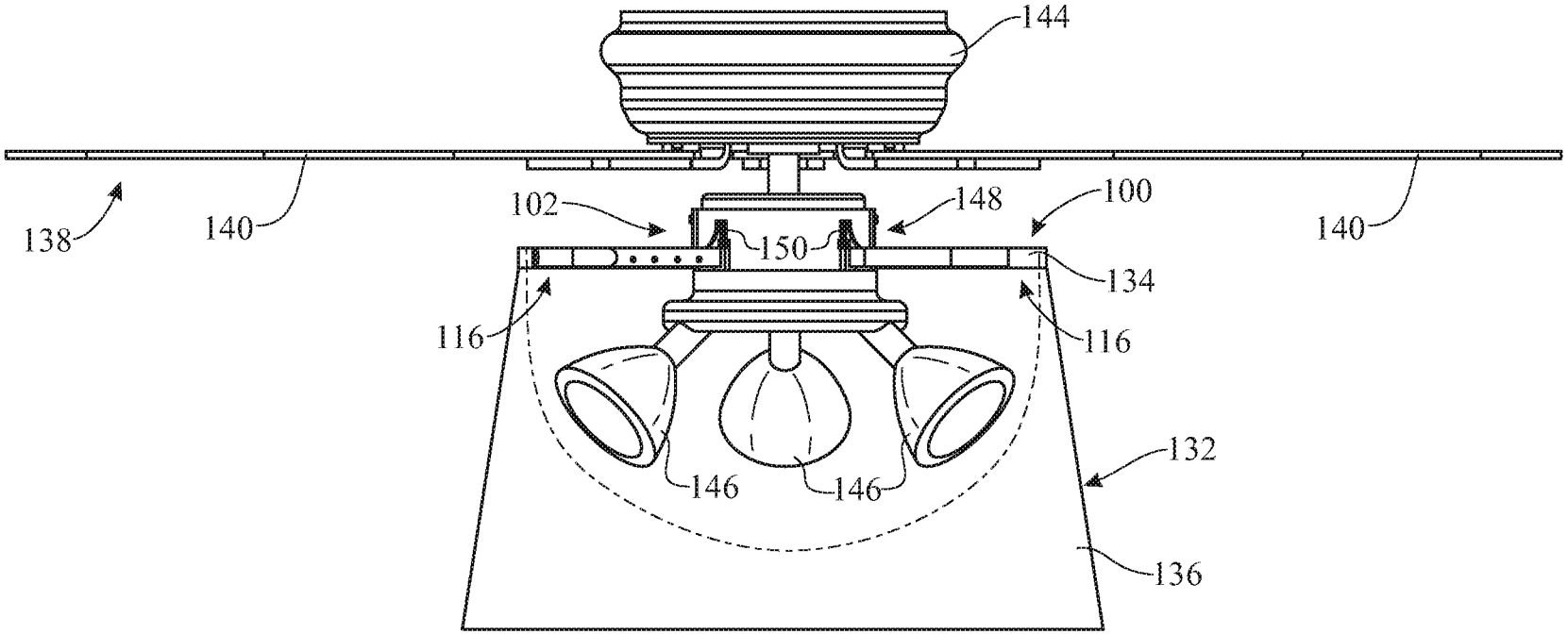
FIG. 7 presents a side view of a ceiling fan with the ceiling fan lampshade mounting assembly mounted on a light fixture having multiple light bulbs on the ceiling fan and the lampshade deployed in place on the ceiling fan lampshade mounting assembly in typical application of the assembly.

Referring initially to FIGS. 1-7, a ceiling fan lampshade mounting assembly, hereinafter assembly 100, is illustrated in accordance with an exemplary embodiment of the invention. As illustrated in FIGS. 6 and 7, in typical application, which will be hereinafter described, the assembly 100 may be secured on a ceiling fan 138. By means of the assembly 100, a lampshade 132 may be attached to the ceiling fan 138 to partially enclose or cover a ceiling fan light globe 142 (FIG. 6), multiple ceiling fan light bulbs 146 (FIG. 7) or other lighting configuration in a ceiling fan light fixture 148. In some embodiments, the assembly 100 may be selectively adjustable in size to accommodate lampshades 132 having different sizes; accordingly, a lampshade 132 of selected style and size can be selected for attachment to the ceiling fan light fixture 148 to suit the aesthetic tastes of a user.

Figure 1:
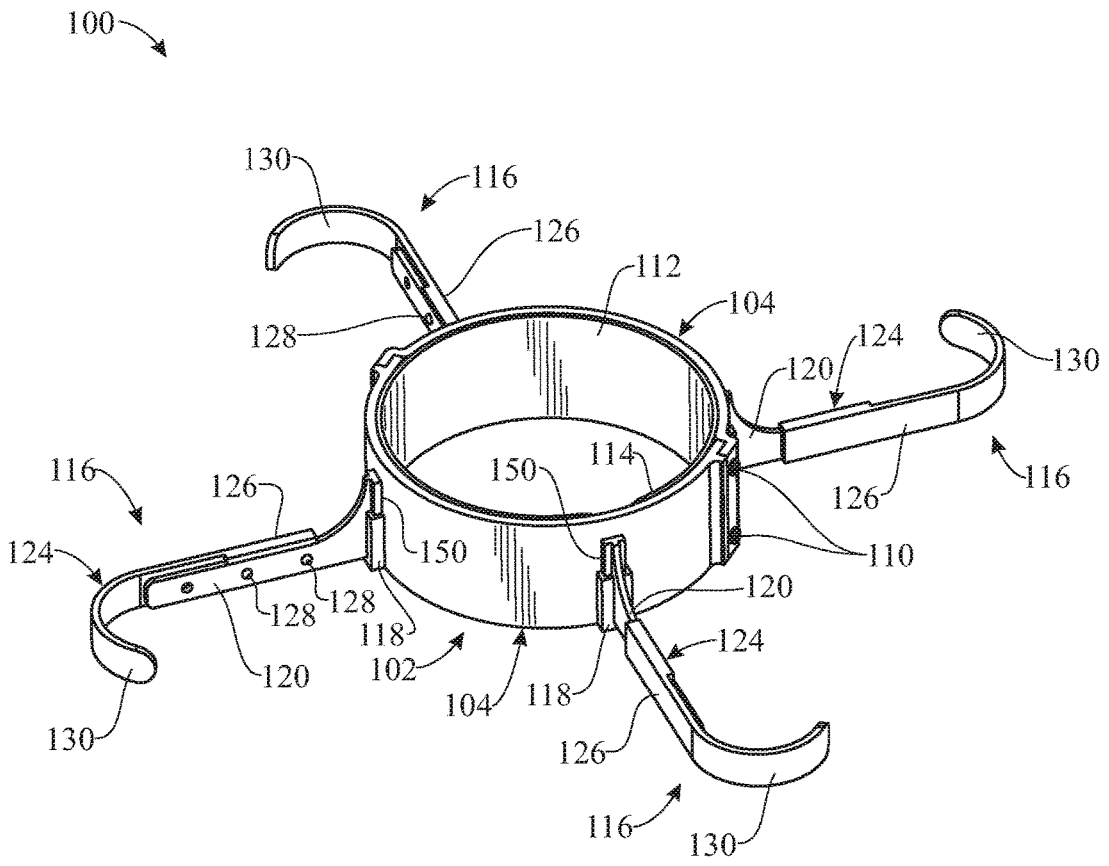
FIG. 1 presents a perspective view showing a first embodiment of the ceiling fan lampshade mounting assemblies of the present invention.
Figure 2:
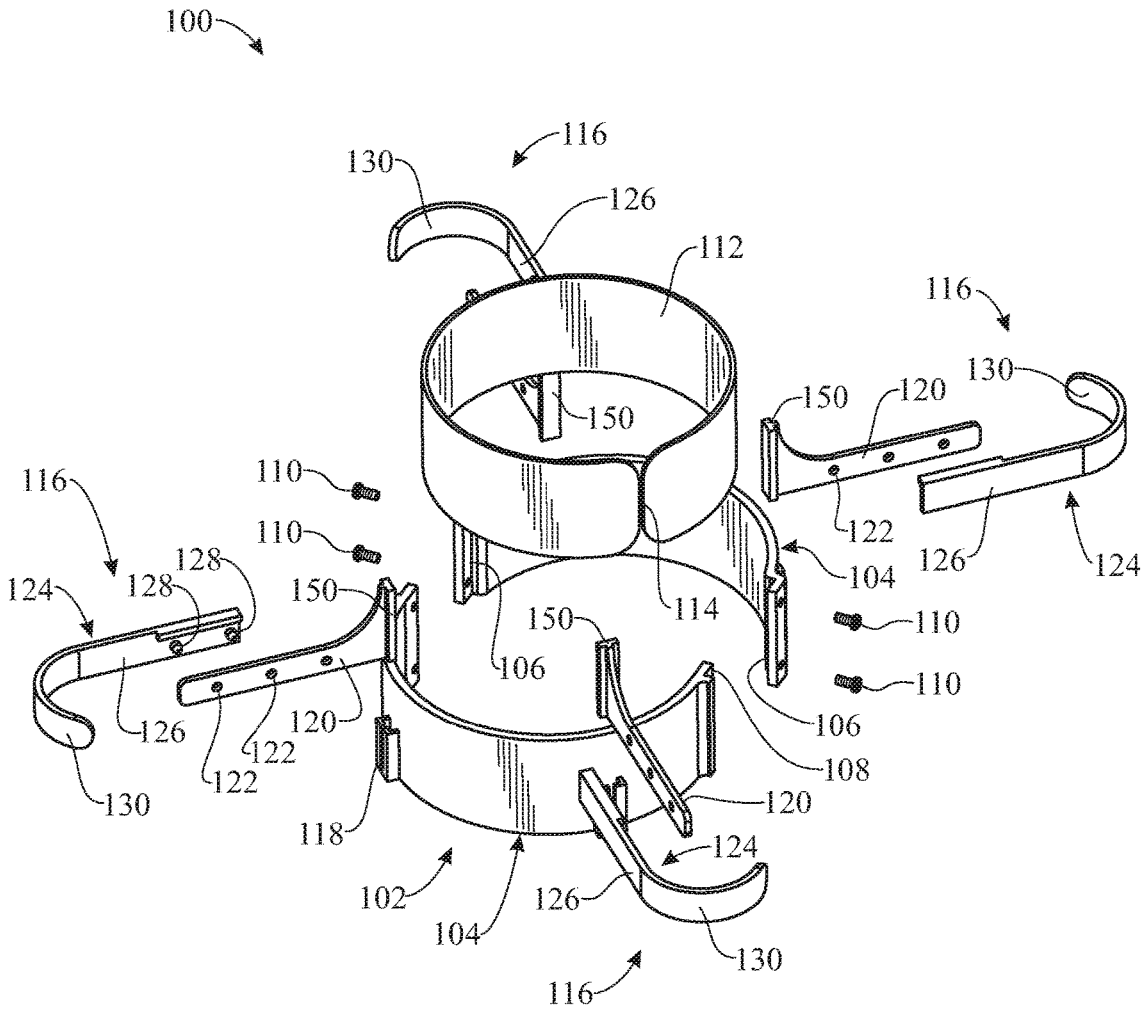
FIG. 2 presents an exploded perspective view of the first embodiment of the ceiling fan lampshade mounting assemblies of the present invention.

The assembly 100 includes an adjustable support 102, as best shown in FIGS. 1 and 2. The adjustable support 102 may include any structure which is capable of being placed and secured around a ceiling fan light fixture 148 having any size and shape. As illustrated in FIG. 2, in some embodiments, the adjustable support 102 may have a pair of complementary support portions 104. The support portions 104 may be generally semicircular in shape, as illustrated. The support portions 104 may be secured to each other and around the ceiling fan light fixture 148 according to any suitable technique. For instance, in some embodiments, one of the pair of support portions 104 may be fitted with a pair of support portion grooves 106. The other of the pair of support portions 104 may be fitted with a companion pair of support portion flanges 108 which are detachably inserted into the respective support portion grooves 106 to form a collar. A pair of support portion fasteners 110 may be threaded through respective fastener openings (not numbered) in each support portion groove 106 and through a registering pair of fastener openings (not numbered) in the corresponding support portion flange 108 to secure the support portions 104 to each other.

In some embodiments, a compressible collar 112 may be disposed inside the adjustable support 102. The compressible collar 112 may be fabricated of a flexible material and may be interrupted by a collar gap 114. The compressible collar 112 may accommodate ceiling fan light fixtures 148 of different diameters or widths by filling a gap (not illustrated) between the ceiling fan light fixture 148 and the adjustable support 102. In alternative embodiments, the adjustable support 102 may include a drawstring type wire with a tightener (not illustrated) or any other structure which facilitates attachment of the assembly 100 to the ceiling fan light fixture 148. For example, such a drawstring type wire may be configured to tighten the support 102 and/or collar 112 around a motor housing of a ceiling fan assembly.

Figure 4:
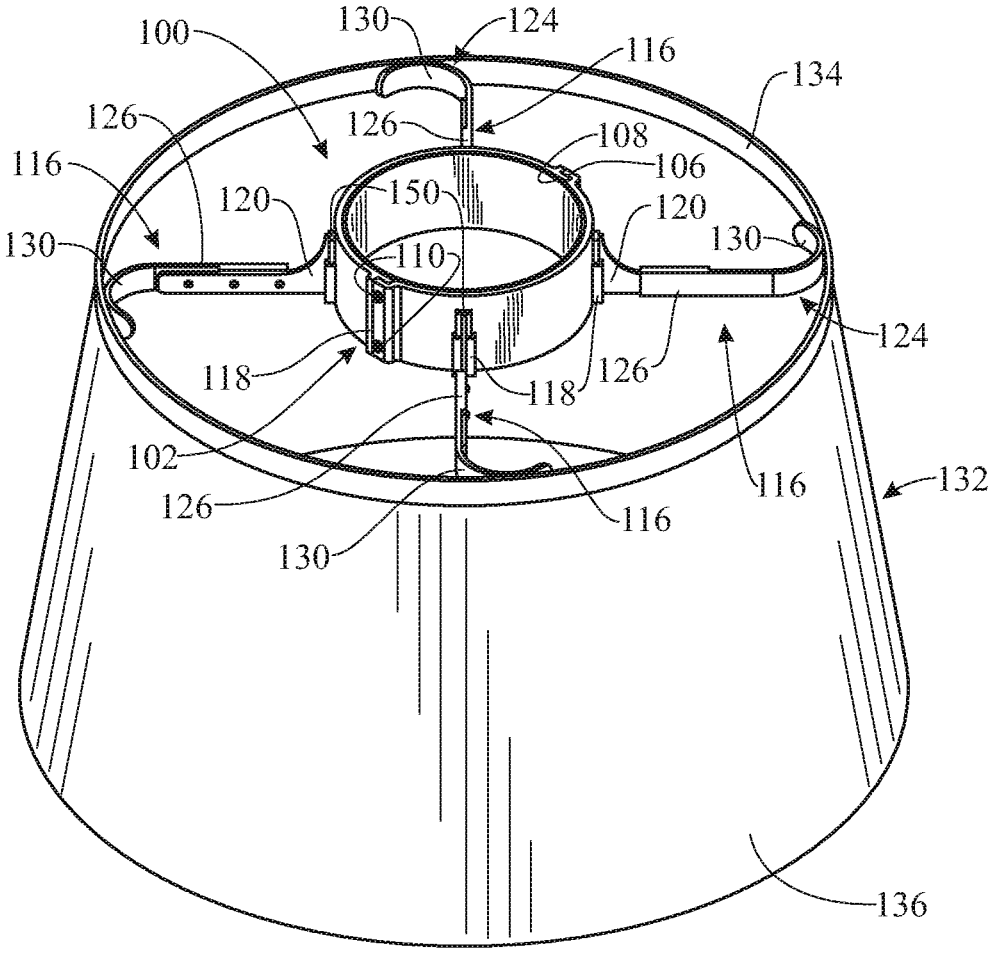
FIG. 4 presents a perspective view of the first embodiment of the ceiling fan lampshade mounting assemblies of the present invention, with a lampshade deployed in place on the ceiling fan lampshade mounting assembly.
Figure 5:
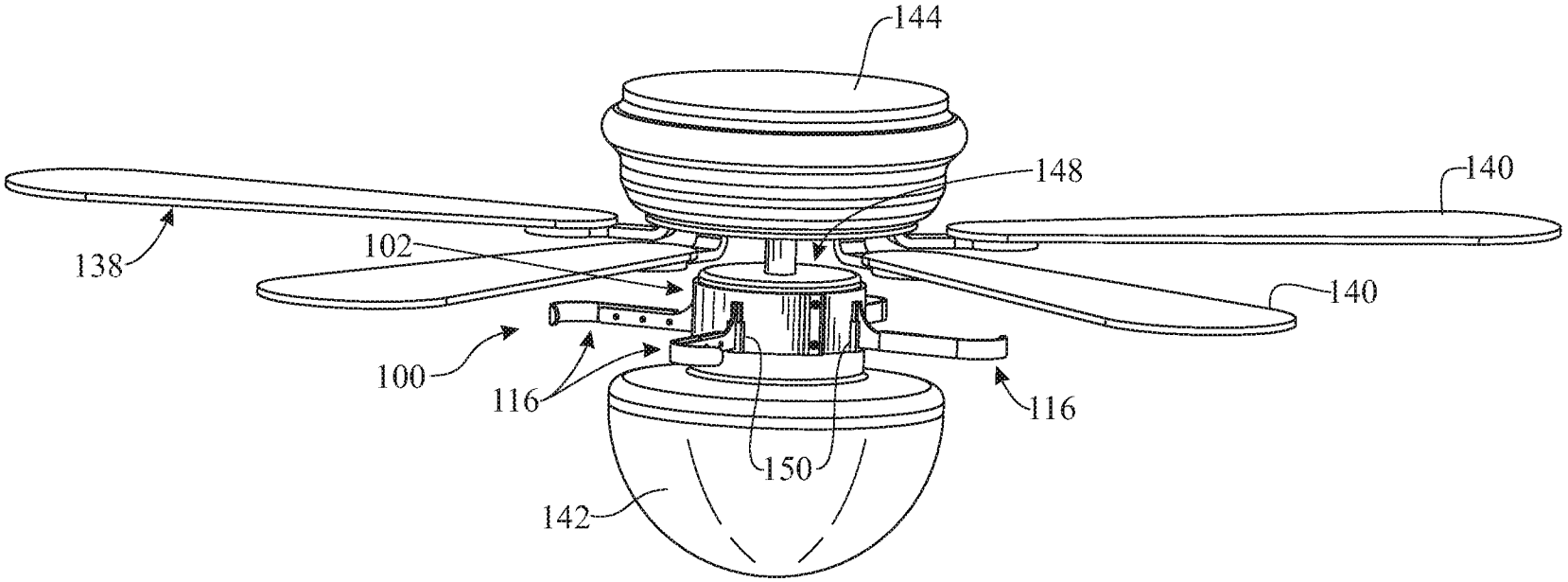
FIG. 5 presents a perspective view of a ceiling fan with the ceiling fan lampshade mounting assembly mounted on a light fixture having a light globe on the ceiling fan preparatory to deployment of a lampshade on the ceiling fan lampshade mounting assembly.

Multiple lampshade support members 116 may extend outwardly from the adjustable support 102 in angular spaced-apart relationship to each other. Each lampshade support member 116 is configured to engage and support the lampshade 132, as illustrated in FIG. 4, and will be hereinafter described. In some embodiments, each lampshade support member 116 may include a generally elongated support arm 120 which extends from the adjustable support 102. A generally elongated arm extension 124 may extend from the support arm 120. The arm extension 124 may include a generally elongated and straight proximal arm segment 126 and a generally elongated and curved lampshade contact segment 130 which extends from the proximal arm segment 126. As illustrated in FIG. 4, the exterior surface of the lampshade contact segment 130 on each lampshade support member 116 may contact the interior surface of the lampshade 132 to support the lampshade 132 on the ceiling fan light fixture 148. Preferably, the lamp support members 116 are elastically deformable so that they can be compressed to allow the assembly 120 to be fitted into the lampshade 132, and tend to recover their original, undeformed shape; in tending to recover their original shape, the lamp support members 116 press against the interior surface of the lampshade 132 to keep the lampshade 132 retained onto the assembly 100 by friction. The support arm 120 and the arm extension 124 of each lampshade support member 116 may be fabricated of a flexible plastic, metal and/or other material.

Figure 3:
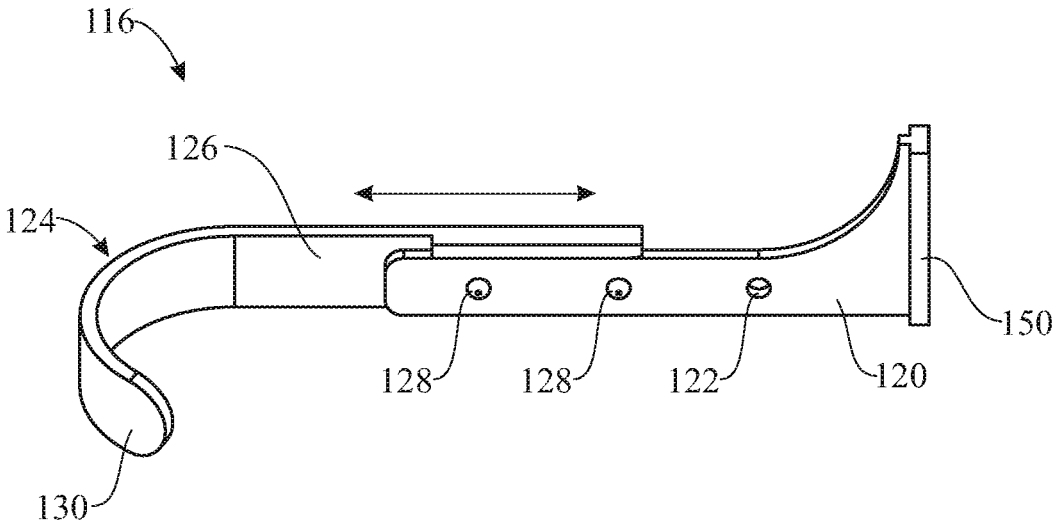
FIG. 3 presents a side view of a typical length-adjustable lampshade support member of the ceiling fan lampshade mounting assemblies of the present invention.

Alternatively or additionally to the lampshade support members 116 being elastically deformable, the lamp shade support members 116 can be length adjustable to adjust to lampshades 132 of different diameters and to adjust the pressing of the lampshade support members 116 against the interior surface of the lampshade 132. For instance, as illustrated in FIG. 3, in some embodiments, the proximal arm segment 126 of the arm extension 124 may be selectively adjustable to different longitudinal positions relative to the support arm 120. In some embodiments, the proximal segment 126 may be secured to a specific position along the support arm 120 by friction (for instance, in a telescopic fashion). In other embodiments, such as that depicted herein, the proximal arm segment 126 of the arm extension 124 may be attached to the support arm 120 by one or more fasteners, such as by extending arm attachment pegs 128 on the proximal arm segment 126 through companion peg openings 122 in the support arm 120. The proximal arm segment 126 may overlap a selected length of the support arm 120 depending on the desired overall length of the lampshade support member 116.

Each lampshade support member 116 may be attached to the adjustable support 102 according to any suitable technique which is suitable for the purpose of affixing the lampshade support members 116 so that they extend radially outward from the adjustable support 102. In some embodiments, such as the embodiment depicted herein, the lampshade support members 116 are removably mounted to the adjustable support 102. For example and without limitation, in some embodiments, multiple support arm mount slots 118 may be provided on the exterior surface of the adjustable support 102; the support arm 120 may be fitted with a support arm flange 150 which is suitably sized and configured to slidably interface with the companion support arm mount slot 118. In alternative embodiments, the support arm 120 may be fabricated in one piece with the adjustable support 102 using molding, casting and/or other techniques known by those skilled in the art.

As illustrated in FIGS. 4-7 of the drawings, in typical application, the assembly 200 is mounted on a ceiling fan 138 to facilitate mounting of a lampshade 132 on the ceiling fan 138. The ceiling fan 138 may have a conventional design with a ceiling fan motor housing. 144 which houses an electric fan motor (not illustrated), multiple ceiling fan blades 140 which are drivingly engaged by the fan motor and a ceiling fan light fixture 148 suspended from the ceiling fan motor housing 144. The assembly 200 may be mounted on the ceiling fan light fixture 148 by securing the adjustable support 102 around the ceiling fan light fixture 148. Accordingly, the compressible collar 112 (FIG. 2) may initially be placed around the ceiling fan light fixture 148. The adjustable support 102 may be secured around the compressible collar 112 by placing the complementary support portions 104 around the compressible collar 112, inserting the support portion flanges 108 on one support portion 104 in the respective companion support portion grooves 106 in the other support portion 104 and fastening the support portions 104 to each other using the support portion fasteners 110. Accordingly, the compressible collar 112 fills the space between the adjustable support 102 and the ceiling fan light fixture 148 to accommodate ceiling fan light fixtures 148 having different diameters or widths.

As illustrated in FIG. 3, each lampshade support member 116 may be assembled by overlapping the proximal arm segment 126 of the arm extension 124 with the support arm 120 at a desired length of the support arm 120 depending on the desired length of the lampshade support member 116. The arm extension 124 may be attached to the support arm 120 by inserting the arm attachment pegs 128 on the proximal arm segment 126 through the respective peg openings 122 in the support arm 120. As further illustrated in FIG. 2, each lampshade support member 116 may be attached to the adjustable support 102 by sliding the support arm flange 150 on the support arm 120 into the companion support arm mount slot 118 on the adjustable support 102.

As illustrated in FIG. 4, the lampshade 132 may have a conventional design with an annular lampshade rim 134 and a flared lampshade body 136 which extends from the lampshade rim 134. The lampshade 132 may be attached to the assembly 100 by raising the lampshade 132 around the ceiling fan light globe 142 (FIG. 6), ceiling fan light bulbs 146 (FIG. 7) or other light arrangement in the ceiling fan light fixture 148 and placing the lampshade rim 134 around the typically curved lampshade contact segments 130 of the arm extensions 124 on the respective lampshade support members 116, which engage the interior surface of the lampshade rim 134. The lampshade contact segments 130 may be pushed inwardly toward the adjustable support 102 to facilitate placement of the lampshade rim 134 around the lampshade support members 116, after which the lampshade contact segments 130 may be released to recoil against the interior surface of the lampshade rim 134. Accordingly, as illustrated in FIGS. 6 and 7, the lampshade body 136 of the lampshade 132 substantially encloses or surrounds the light arrangement in the ceiling fan light fixture 148.

It will be appreciated by those skilled in the art that the assembly 100 can be mounted on ceiling fan light fixtures 148 having various diameters or widths without structural modification to the ceiling fan light fixtures 148. The lampshade 132 can be selectively removed from the assembly 100 for cleaning, repair or replacement typically by disengagement of the lampshade contact segments 130 on the respective lampshade support members 116 from the interior surface of the lampshade rim 134 and removal of the lampshade 132 from around the light arrangement on the ceiling fan light fixture 148. The assembly 100 can be selectively removed from the ceiling fan light fixture 148 typically by removal of the support portion fasteners 110 (FIG. 2), disassembly and disengagement of the support portions 104 from the compressible collar 112 and removal of the compressible collar 112 of the adjustable support 102 from the ceiling fan light fixture 148.

Figure 8:
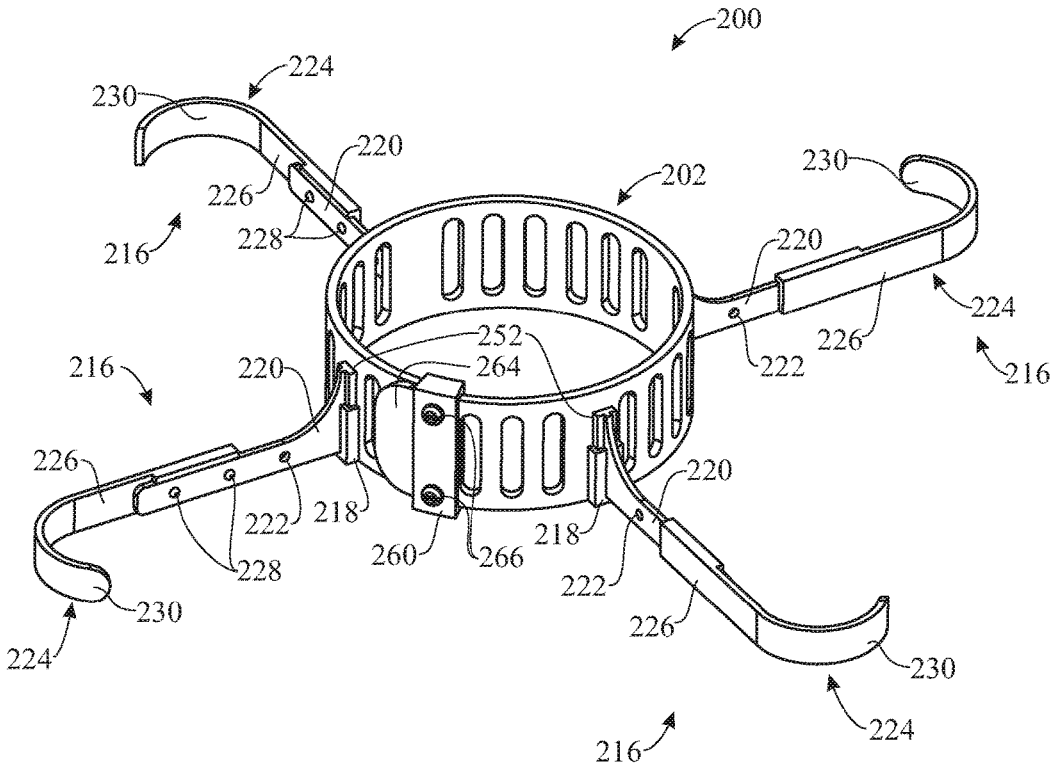
FIG. 8 presents a perspective view of a second embodiment of the ceiling fan lampshade mounting assemblies of the present invention.
Figure 9:
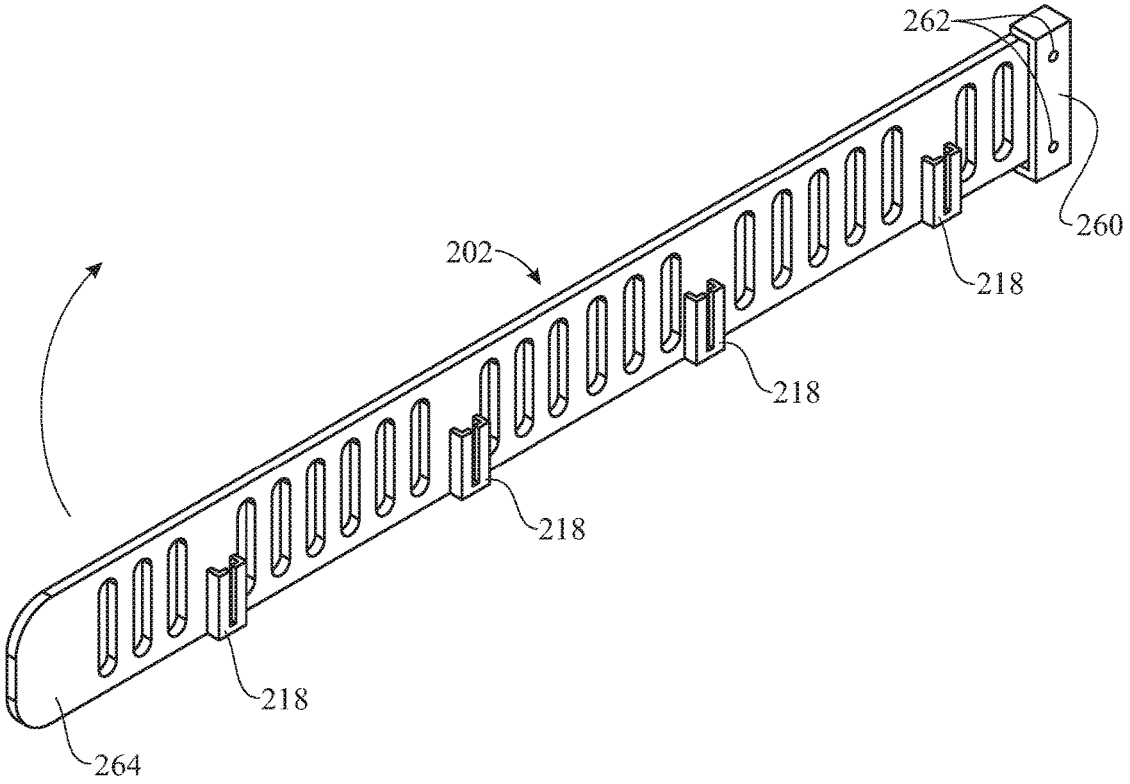
FIG. 9 is a perspective view of a typical support portion of the second embodiment of the ceiling fan lampshade mounting assembly illustrated in FIG. 8, with the support portion in an unfastened and extended configuration.

Referring next to FIGS. 8 and 9 of the drawings, an alternative illustrative embodiment of the ceiling fan lampshade mounting assembly is generally indicated by reference numeral 200. In FIGS. 8 and 9, elements corresponding to the same elements of the assembly 100 which was heretofore described with respect to FIGS. 1-7 are indicated by the same numerals in the 200-299 series. The adjustable support 202 of the assembly 200 may include a single elongated belt, strap or other member. A support stay 260 may be provided on a first end of the adjustable support 202. As illustrated in FIG. 9, the support stay 260 receives an insertion end 264 of the adjustable support 202. At least one insertion stay fastener opening 262 may be provided in the support stay 260. At least one support stay fastener 266 (FIG. 8) may be threaded through the insertion stay fastener opening 262 and tightened against the adjustable support 202 to secure the adjustable support 202 in a selected diameter.

As further illustrated in FIG. 9, multiple support arm mount slots 218 may be provided in spaced-apart relationship to each other on the adjustable support 202. Each of the lampshade support members 216 may have a design which is the same as or similar to that of the lampshade support members 116 of the assembly 100. Accordingly, each lampshade support member 216 may be attached to the adjustable support 202 by inserting the support arm flange 250 on the support arm 220 of each lampshade support member 216 in the corresponding companion support arm mount slot 218.

Application of the assembly 200 may be as was heretofore described with respect to the assembly 100 in FIGS. 4-7. The size of the adjustable support 202 can be selected by sliding the insertion end 264 of the adjustable support 202 in the support stay 260 and securing the adjustable support 202 using the support stay fasteners 266. Thus, different lengths of the lampshade support member 216 may be secured in the support stay 260 depending on the diameter or width of the ceiling fan light fixture 148.

It will be appreciated by those skilled in the art that the assemblies can be used in a variety of applications to mount a lampshade on a structure. In some applications, the assemblies can be used to mount a lampshade to a ceiling fan light fixture on a ceiling fan, as was heretofore described. In other applications, the assemblies can be used to mount a lampshade on a ceiling light (not illustrated) which may not be included as part of a ceiling fan. In still other applications, the assembly can be used to mount a lampshade on a ceiling fan which does not include a light fixture. Thus, the mounted lampshade may impart a desired decorative or aesthetic appearance apart from any lighting effects.

Figure 10:
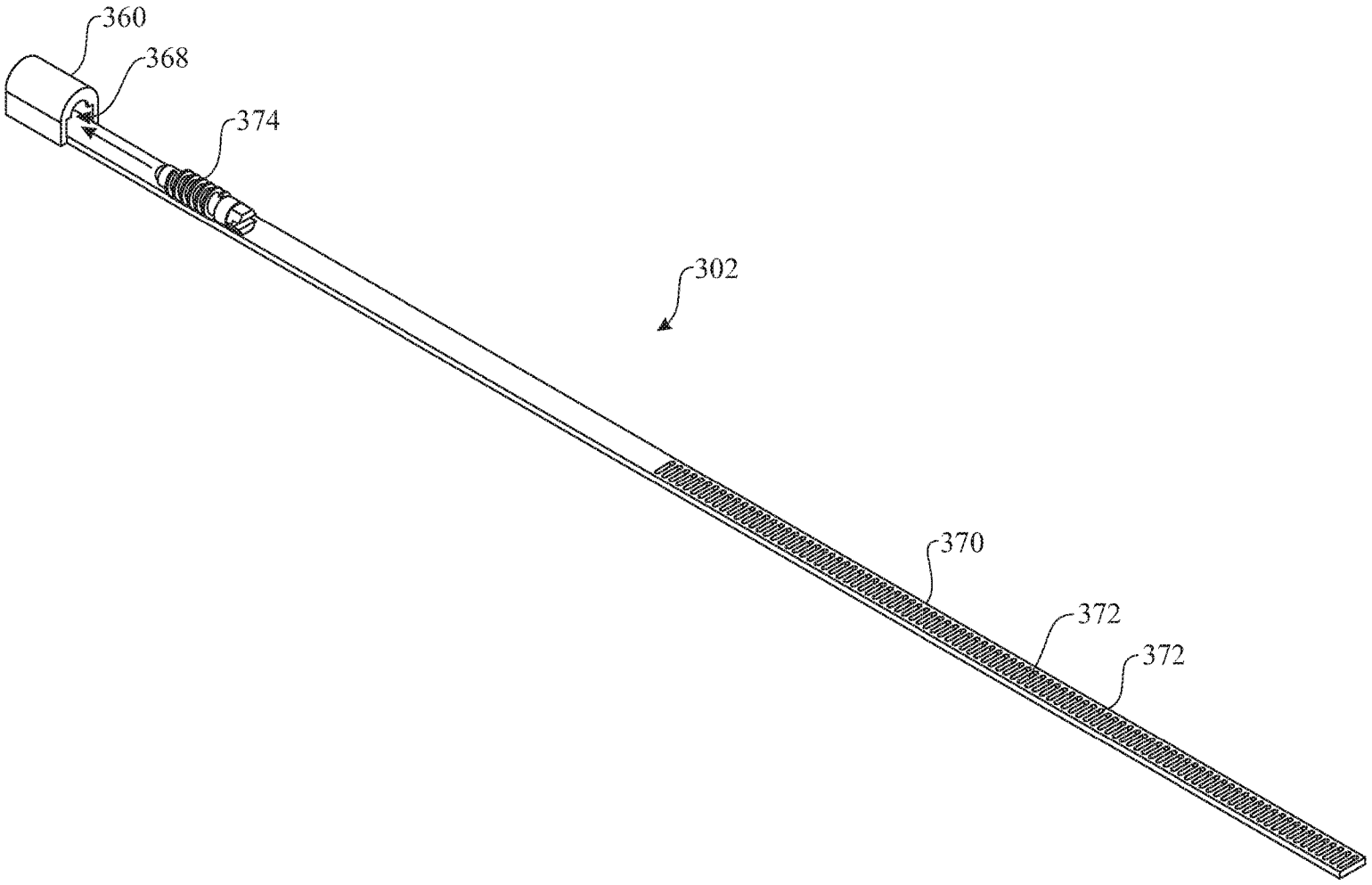
FIG. 10 presents a perspective view of an adjustable support of yet another embodiment of a ceiling fan lampshade mounting assembly in accordance with the invention, the adjustable support shown extended.
Figure 11:
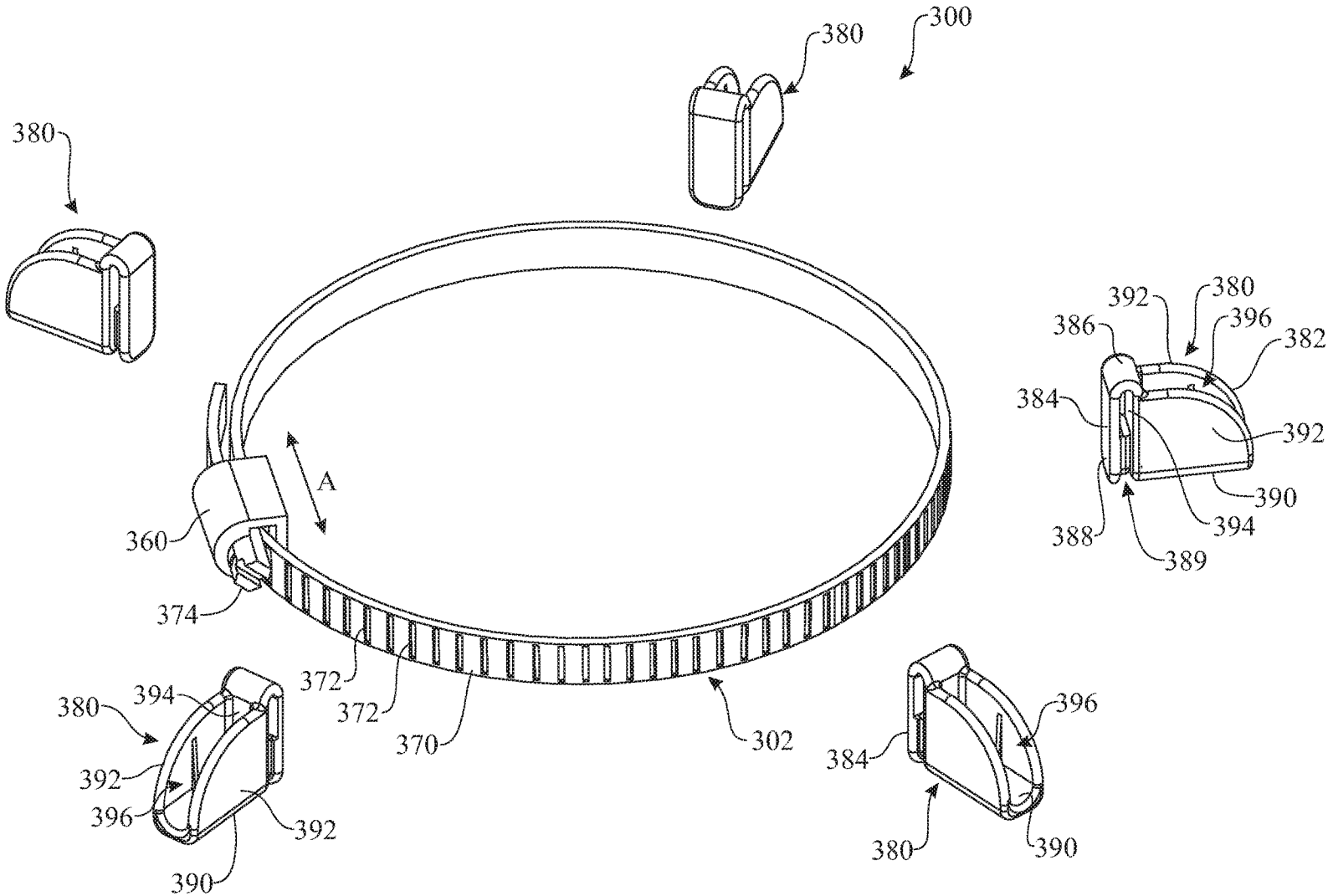
FIG. 11 presents the adjustable support of FIG. 10 and associated lampshade support members forming the ceiling fan lampshade mounting assembly, the assembly shown exploded.
Figure 12:
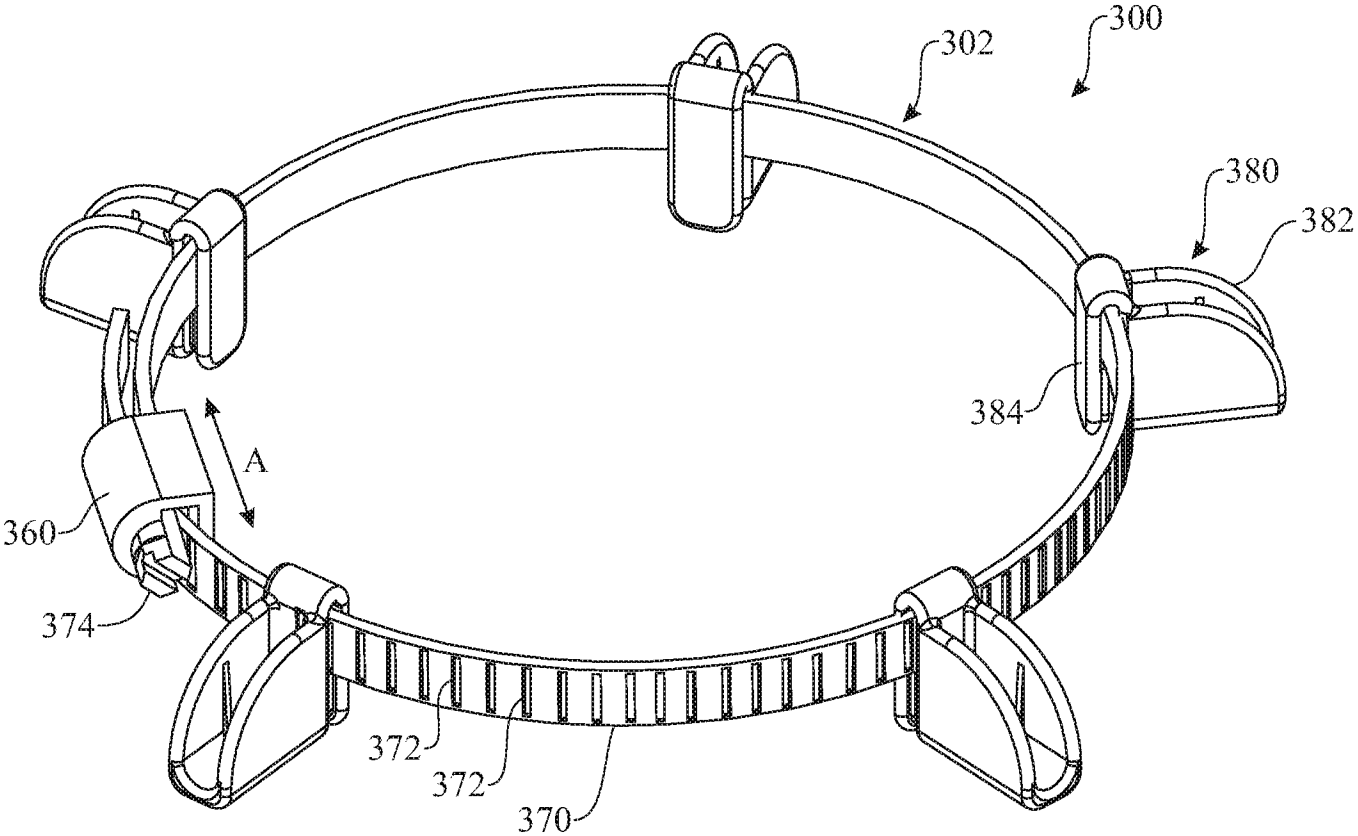
FIG. 12 presents the assembly of FIG. 11, shown assembled.
Figure 13:
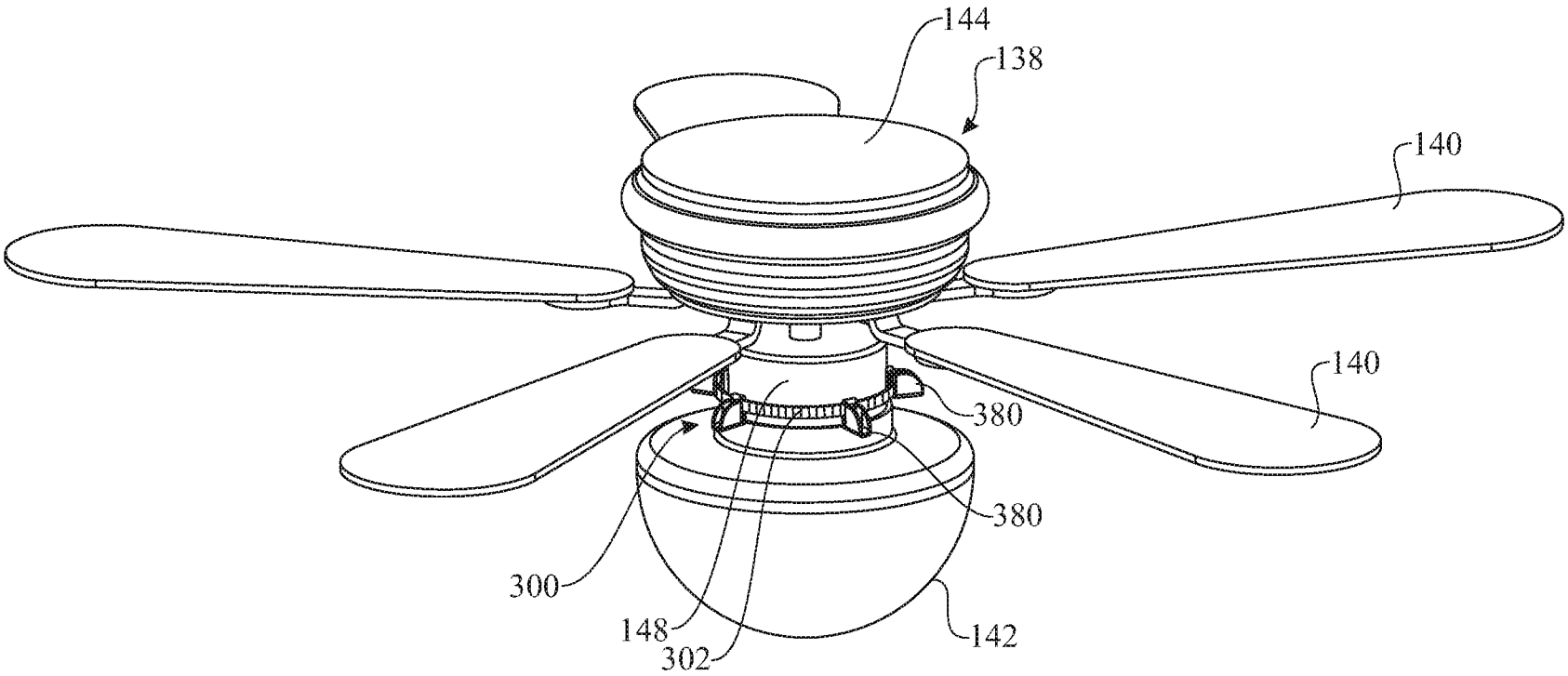
FIG. 13 presents the assembly of FIG. 12, secured to a ceiling fan.

Referring next to FIGS. 10-12, a further alternative illustrative embodiment of the ceiling fan lampshade mounting assembly is generally indicated by reference numeral 300. In FIGS. 10-12, elements corresponding to the same elements of the assembly 100 which was heretofore described with respect to FIGS. 1-7 are indicated by the same numerals in the 300-399 series in the present assembly 300.

Similarly to the previous embodiments, the assembly 300 includes an adjustable support 302. The adjustable support 302 is formed as a flexible collar o strip. The adjustable support 302 can adopt an initial, extended and generally straight position shown in FIG. 10, which is particularly suitable for storage and transportation. At or near a first end thereof, the adjustable support 302 includes a slotted section 370 having parallel, transverse receiving cavities 372. In some embodiments, the receiving cavities 372 can be formed as through slots in the adjustable support 302. Alternatively, the receiving cavities 372 can be formed as non-through cavities or recesses. At or near a second end of the adjustable support 302 opposite to the first end, the adjustable support 302 comprises a support stay 360 delimiting a through cavity 368 for the insertion therethrough of the first end of the adjustable support 302 in order for the adjustable support 302 to form a ring or loop, as shown in FIG. 11. A threaded fastener 374 is arranged in the through cavity 368 in such a way that threads of the threaded fastener 374 engage with the receiving cavities 372 of the adjustable support 302. Clockwise or counterclockwise rotation of the threaded fastener 374 (e.g. by a screwdriver) causes the slotted section 370 of the adjustable support 302 to move along the cavity 368 of the support stay 360 back or forth as indicated by arrow A in FIG. 11.

As best shown in FIGS. 11 and 12, the assembly 300 further includes a plurality of lampshade support members 380 which are formed separately from the adjustable support 302. The lampshade support members 380 are disconnectably attachable to the adjustable support 302. In some embodiments, the lampshade support members 380 are repeatedly disconnectable and connectable, for instance by means of a hooked attachment best shown in FIG. 11; specifically, each lampshade support member 380 includes a lampshade support member body 382 and a rear hook 384 for hooking onto the adjustable support 302. The rear hook 384 comprises a connecting portion 386 and a distal portion 388. The distal portion 388 is arranged rearward of the lampshade support member body 382 and in a spaced-apart configuration with the lampshade support member body 382, defining a space 389 therebetween for receiving the adjustable support 302. The lampshade support member body 382 includes a bottom wall or floor 390, opposite side walls 392 and a rear wall 394 delimiting a cavity 396 therebetween. The cavity 396 is generally elongated and arranged so that, when the lampshade support member 380 is hook onto the adjustable support 302 (FIG. 12), the cavity 396 extends radially outward from the looped adjustable support 302.

Preferably, the lampshade support members 380 are attached (e.g. hooked) to the adjustable support 302 in a slidable manner along the adjustable support 302, allowing the user to vary the relative angular placement of the lampshade support members 380 relative to one another.

The illustrations of FIGS. 13-17 show a sequence of steps for installing a lampshade 400 on a ceiling fan 138. Similarly to the previous embodiments, the user can begin by attaching the adjustable support 302 to the ceiling fan 138. For this purpose, the user wraps the initially straight adjustable support 302 (FIG. 10) around the ceiling fan light fixture 148 and inserts the slotted section 370 into the cavity 368 of the support stay 360 while operating the fastener 374 to form a loop (FIG. 11) which adjusts to the ceiling fan light fixture 148 but leaves a slight gap therebetween allowing for the hooking of the lampshade support members 380 onto the adjustable support 302.

Figure 14:
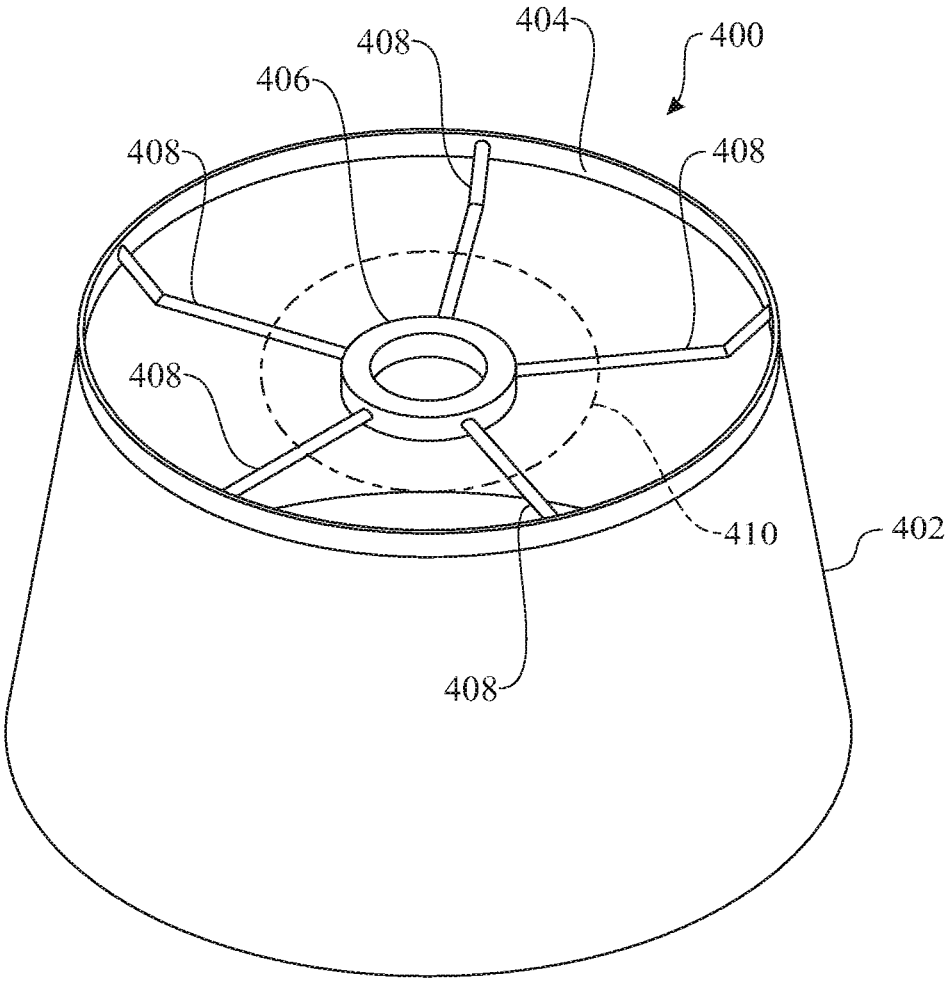
FIG. 14 presents a lampshade, indicating a cutting line.
Figure 15:
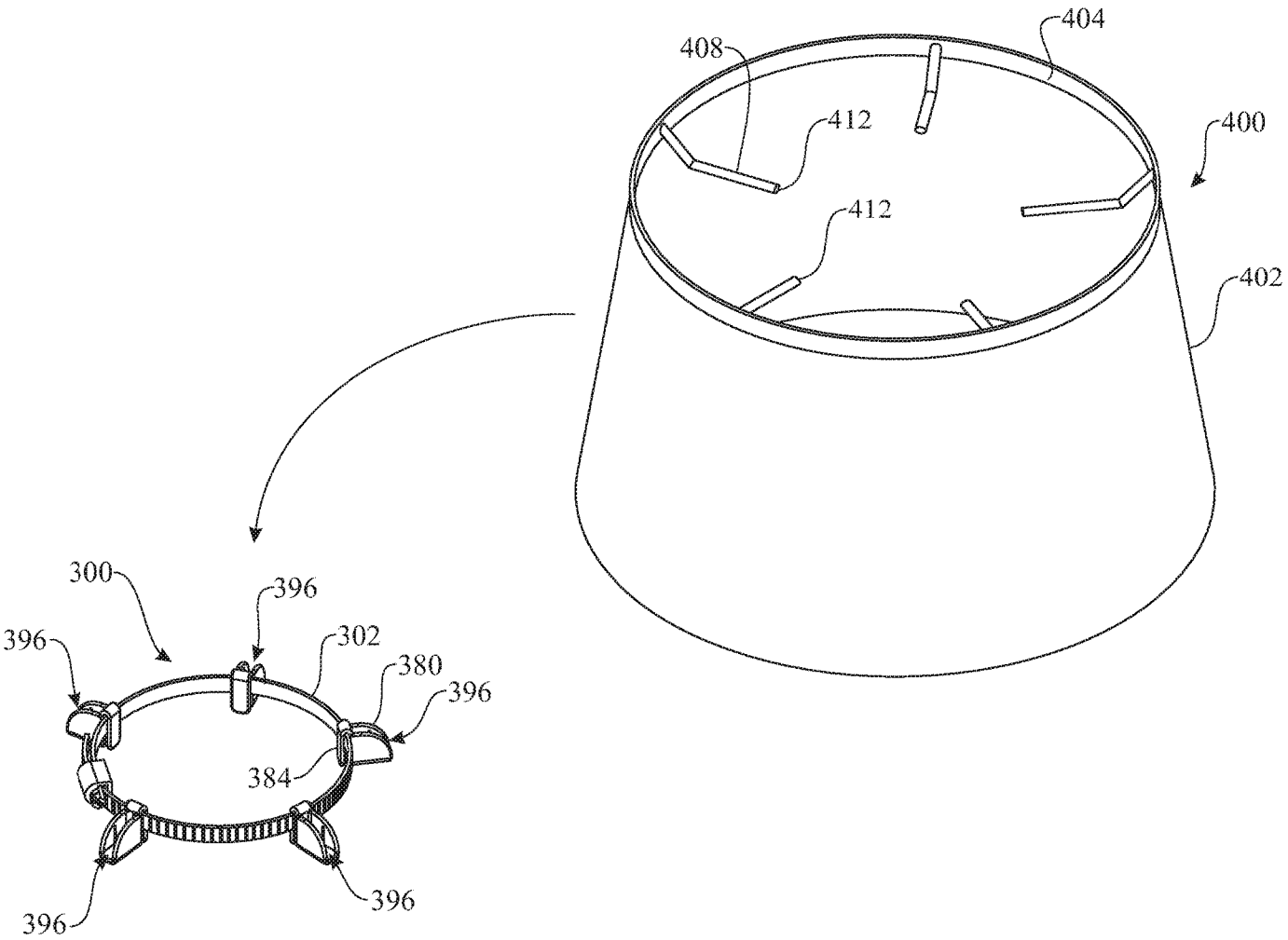
FIG. 15 presents a remainder of the lampshade of FIG. 14, after having cut along the cutting line, the remainder of the lampshade being fitted onto the assembly of FIG. 12.

Next, the user obtains an existing lampshade 400 as shown in FIG. 14, of the kind that includes a lampshade body 402, a lampshade rim 404, a central ring 406 and a plurality of spokes 408 extending radially from the central ring 406 to the lampshade rim 404. The user then cuts the spokes 408 at a specific length (as indicated by a circle 410 shown in broken lines in FIG. 14), and removes the cut portion (i.e. the central ring 406 and attached portions of the spokes 408). The remainder of the lampshade 400, shown in FIG. 15, presents the remainders of the spokes 408 ending in free ends 412. The specific length at which the spokes 408 are cut (i.e. the diameter of the circle 410) is such that the free ends 412 of the remainders of the spokes 408 are arranged to fit into the cavities 396 of the lampshade support members 380.

Figure 16:
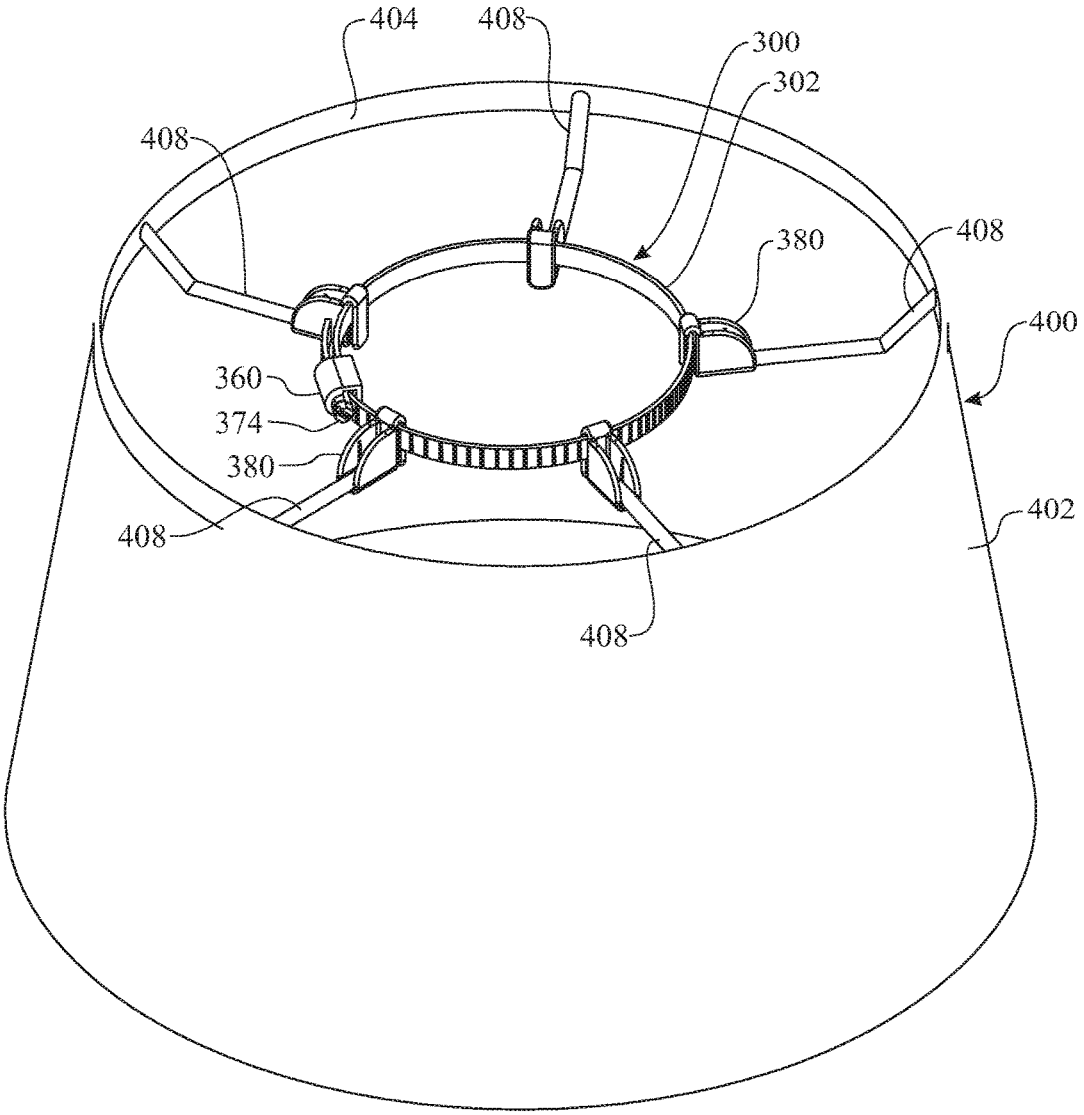
FIG. 16 presents the assembly and the remainder of the lampshade, shown assembled.

As shown in FIG. 15, the user can then hook the lampshade support members 380 to the adjustable support 302, and fit the lampshade 400 onto the adjustable support 302 and attached lampshade support members 380 while slidably adjusting the lampshade support members 380 along the adjustable support 302 to facilitate the free ends 412 being received into the cavities 396 of the lampshade support members 380. Once all free ends 412 are received in the cavities 396, the assembled situation of FIG. 16 is achieved.

Figure 17:
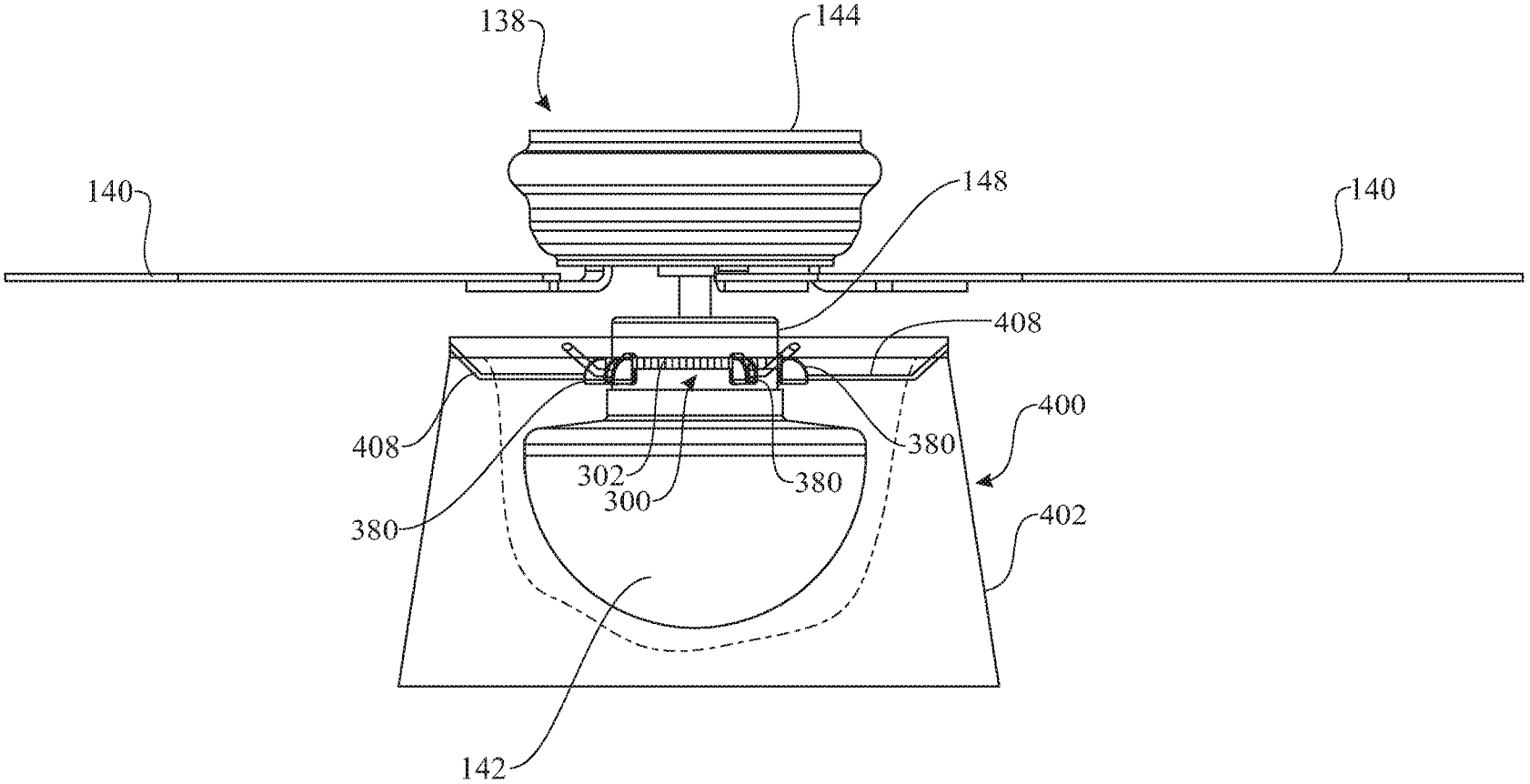
FIG. 17 presents the assembly of FIG. 16, secured to the ceiling fan of FIG. 13.

The user can then operate the fastener 374 to further tighten the adjustable support 302 to the ceiling fan light fixture 148, securing the assembly 300 and the lampshade 400 to the ceiling fan 138, as shown in FIG. 17.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A ceiling fan lampshade mounting assembly, for mounting a lampshade on a ceiling fan, the assembly comprising:

an adjustable support configured for attachment to the ceiling fan by adjustably looping around a perimeter of the ceiling fan; and a plurality of lampshade support members, wherein each of the lampshade support members is formed as a separate piece and comprises a cavity and a hook, wherein the hook is configured to hook onto the adjustable support, and the cavity is configured to receive an end of a lampshade spoke; wherein the ceiling fan lampshade mounting assembly is configured to adopt a working position in which the adjustable support forms a loop arranged around and adjusted onto a perimeter of the ceiling fan, and in which the plurality of lampshade support members are hooked onto and carried by the adjustable support at angularly-spaced apart positions relative to one another, and further in which the cavities of the lampshade support members are oriented radially outward of the adjustable support to receive proximal ends of a plurality of spokes of a lampshade.

2. The ceiling fan lampshade mounting assembly of claim 1, wherein the at least one of the lampshade support members is removably hooked onto the adjustable support when the ceiling fan lampshade mounting assembly is in the working position.

3. The ceiling fan lampshade mounting assembly of claim 1, wherein at least one of the lampshade support members is slidably carried by the adjustable support along said loop.

4. The ceiling fan lampshade mounting assembly of claim 1, said loop being size-adjustable.

5. The ceiling fan lampshade mounting assembly of claim 1, wherein the adjustable support comprises at least one fastener to retain the adjustable support onto the perimeter of the ceiling fan in the working position.

6. The ceiling fan lampshade mounting assembly of claim 1, wherein the lampshade support members comprise a respective body having a floor and side walls delimiting the cavity.

7. A ceiling fan lampshade mounting assembly, for mounting a lampshade on a ceiling fan, the assembly comprising:

an adjustable support configured for attachment to the ceiling fan by adjustably looping around a perimeter of the ceiling fan; and a plurality of lampshade support members, wherein each of the lampshade support members is formed as a separate piece and comprises a cavity and a hook, wherein the hook is configured to hook onto the adjustable support, and the cavity is configured to receive an end of a lampshade spoke; wherein the ceiling fan lampshade mounting assembly is configured to adopt a working position in which the adjustable support forms a loop arranged around and adjusted onto a perimeter of the ceiling fan, said loop being size-adjustable, and in which the plurality of lampshade support members are hooked onto and carried by the adjustable support at angularly-spaced apart positions relative to one another, and further in which the cavities of the lampshade support members are oriented radially outward of the adjustable support to receive proximal ends of a plurality of spokes of a lampshade.

8. The ceiling fan lampshade mounting assembly of claim 7, wherein at least one of the lampshade support members is removably hooked onto the adjustable support when the ceiling fan lampshade mounting assembly is in the working position.

9. The ceiling fan lampshade mounting assembly of claim 7, wherein at least one of the lampshade support members is slidably carried by the adjustable support along said loop.

10. The ceiling fan lampshade mounting assembly of claim 7, wherein the lampshade support members comprise a respective body having a floor and side walls delimiting the cavity.

11. The ceiling fan lampshade mounting assembly of claim 7, wherein the adjustable support comprises at least one fastener to retain the adjustable support onto the perimeter of the ceiling fan in the working position.

12. A ceiling fan lampshade mounting assembly, for mounting a lampshade on a ceiling fan, the assembly comprising:

a lampshade comprising a plurality of spokes having a proximal end and a distal end arranged radially outward of the proximal end;

an adjustable support configured for attachment to the ceiling fan by adjustably looping around a perimeter of the ceiling fan; and a plurality of lampshade support members, wherein each of the lampshade support members is formed as a separate piece and comprises a cavity and a hook, wherein the hook is configured to hook onto the adjustable support; wherein the ceiling fan lampshade mounting assembly is configured to adopt a working position in which the adjustable support forms a loop arranged around and adjusted onto a perimeter of the ceiling fan, and in which the plurality of lampshade support members are hooked onto and carried by the adjustable support at angularly-spaced apart positions relative to one another, and further in which the cavities of the lampshade support members are oriented radially outward of the adjustable support and receive the proximal ends of the plurality of spokes of the lampshade.

13. The ceiling fan lampshade mounting assembly of claim 12, wherein the at least one of the lampshade support members is removably hooked onto the adjustable support when the ceiling fan lampshade mounting assembly is in the working position.

14. The ceiling fan lampshade mounting assembly of claim 12, wherein at least one of the lampshade support members is slidably carried by the adjustable support along said loop.

15. The ceiling fan lampshade mounting assembly of claim 12, said loop being size-adjustable.

16. The ceiling fan lampshade mounting assembly of claim 12, wherein the adjustable support comprises at least one fastener to retain the adjustable support onto the perimeter of the ceiling fan in the working position.

17. The ceiling fan lampshade mounting assembly of claim 12, wherein the lampshade support members comprise a respective body having a floor and side walls delimiting the cavity.

* * * * *